US007210742B2

(12) United States Patent
Wu

(10) Patent No.: US 7,210,742 B2
(45) Date of Patent: May 1, 2007

(54) DISTANCE ADJUSTMENT DEVICE FOR CHAIR

(76) Inventor: Yao-Chuan Wu, 1-1, Nelpuzai, Daqi Cun, Min Xiung Hsiang, Jiayi Hsien (TW)

( * ) Notice: Subject to any disclaimer, the term of this patent is extended or adjusted under 35 U.S.C. 154(b) by 0 days.

(21) Appl. No.: 11/086,698

(22) Filed: Mar. 22, 2005

(65) Prior Publication Data

US 2006/0226684 A1 Oct. 12, 2006

(51) Int. Cl.
*B60N 2/02* (2006.01)

(52) U.S. Cl. ..... 297/353; 297/183.1; 297/183.7; 297/183.6; 297/463.1

(58) Field of Classification Search ..... 297/353, 297/463.1, 410, 344.12, 411.36, 423.45, 183.1, 297/183.6, 183.7; 403/322.4, 105, 80
See application file for complete search history.

(56) References Cited

U.S. PATENT DOCUMENTS 4,012,158 A * 3/1977 Harper ..... 403/107
4,036,525 A * 7/1977 Howk ..... 297/353
5,435,626 A * 7/1995 Lai ..... 297/411.36
5,439,267 A * 8/1995 Peterson et al. ..... 297/411.36
5,551,754 A * 9/1996 Neumueller ..... 297/353
5,664,842 A * 9/1997 Tseng ..... 297/411.36
6,053,578 A * 4/2000 van Hekken et al. ... 297/411.35
6,062,646 A * 5/2000 Bock ..... 297/411.36
6,062,647 A * 5/2000 Mei ..... 297/411.36
6,296,313 B1 * 10/2001 Wu ..... 297/411.35
6,354,664 B1 * 3/2002 Chen ..... 297/353
6,729,692 B1 * 5/2004 Chou ..... 297/463.1
6,896,333 B1 * 5/2005 Matern et al. ..... 297/411.36
2005/0093356 A1 * 5/2005 Liu ..... 297/353

* cited by examiner

*Primary Examiner*—David R. Dunn
*Assistant Examiner*—Erika Garrett
(74) *Attorney, Agent, or Firm*—Alan D. Kamrath; Nikolai & Mersereau, P.A.

(57) ABSTRACT

A distance adjustment device for a chair includes a guide rail, a movable plate slidably mounted on the guide rail, a movable handle pivotally mounted on the movable plate and having a first end detachably engaged with the guide rail, and a fixed handle secured on the movable plate and located opposite to a second end of the movable handle. Thus, the user only needs to hold the push portion of the movable handle and the grip portion of the fixed handle by his one hand to unlock and move the movable plate, so that the distance adjustment device is operated by the user's one hand.

12 Claims, 5 Drawing Sheets

DISTANCE ADJUSTMENT DEVICE FOR CHAIR

BACKGROUND OF THE INVENTION

1. Field of the Invention

The present invention relates to a distance adjustment device, and more particularly to a distance adjustment device for a chair.

2. Description of the Related Art

A conventional distance adjustment device is mounted on a chair and comprises a guide rail fixed on a seat portion of the chair, and a movable plate is fixed on a backrest or an armrest of the chair and slidably mounted on the guide rail. Thus, the movable plate is movable relative to the guide rail so as to adjust the distance between the backrest or armrest and the seat portion. In operation, a user holds the guide rail by his one hand and applies a force on the movable plate by his other hand to drive the movable plate to move relative to the guide rail to adjust the relative position between the movable plate and the guide rail so as to adjust the distance between the backrest or armrest and the seat portion. However, the user has to operate the conventional distance adjustment device by his two hands, thereby causing inconvenience to the user in the distance adjustment, and thereby wasting the user's manual work.

SUMMARY OF THE INVENTION

In accordance with the present invention, there is provided a distance adjustment device, comprising a guide rail, a movable plate slidably mounted on the guide rail, a movable handle pivotally mounted on the movable plate and having a first end detachably engaged with the guide rail, and a fixed handle secured on the movable plate and located opposite to a second end of the movable handle.

The primary objective of the present invention is to provide a distance adjustment device that is operated easily and conveniently.

Another objective of the present invention is to provide a distance adjustment device, wherein the user only needs to hold the push portion of the movable handle and the grip portion of the fixed handle by his one hand to unlock and move the movable plate so as to adjust the relative position between the movable plate and the guide rail, so that the distance adjustment device is operated by the user's one hand, thereby facilitating the user adjusting the distance between the backrest (or the armrest) and the seat portion.

A further objective of the present invention is to provide a distance adjustment device, wherein the user only needs to push the push portion of the movable handle toward the grip portion of the fixed handle to unlock and move the movable plate, so that the movable plate is moved easily and rapidly, thereby facilitating the user operating the distance adjustment device.

A further objective of the present invention is to provide a distance adjustment device, wherein the movable plate is fixed on the guide rail automatically by the restoring force of the elastic member after the distance adjustment, thereby facilitating the user operating the distance adjustment device.

A further objective of the present invention is to provide a distance adjustment device having a simplified construction, thereby decreasing costs of fabrication.

Further benefits and advantages of the present invention will become apparent after a careful reading of the detailed description with appropriate reference to the accompanying drawings.

DETAILED DESCRIPTION OF THE INVENTION

Figure 1:
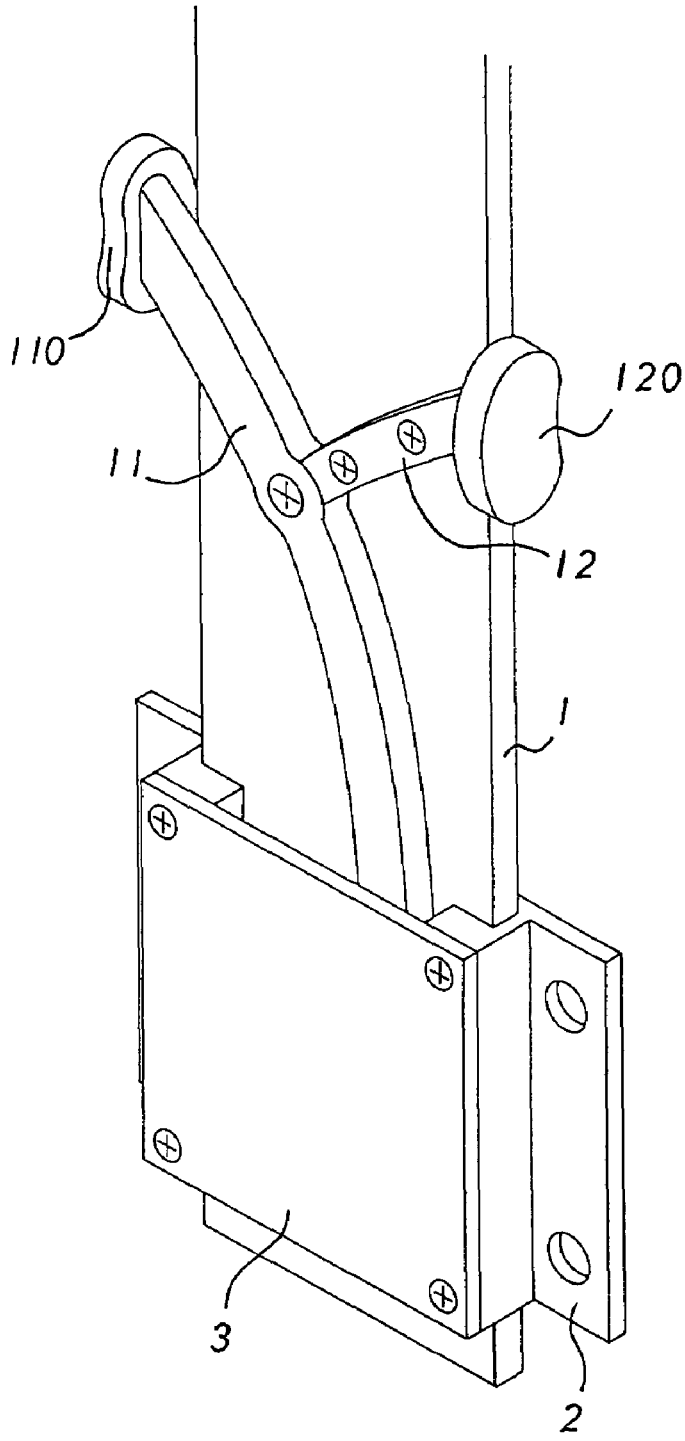
FIG. 1 is a perspective view of a distance adjustment device for a chair in accordance with the preferred embodiment of the present invention.
Figure 2:
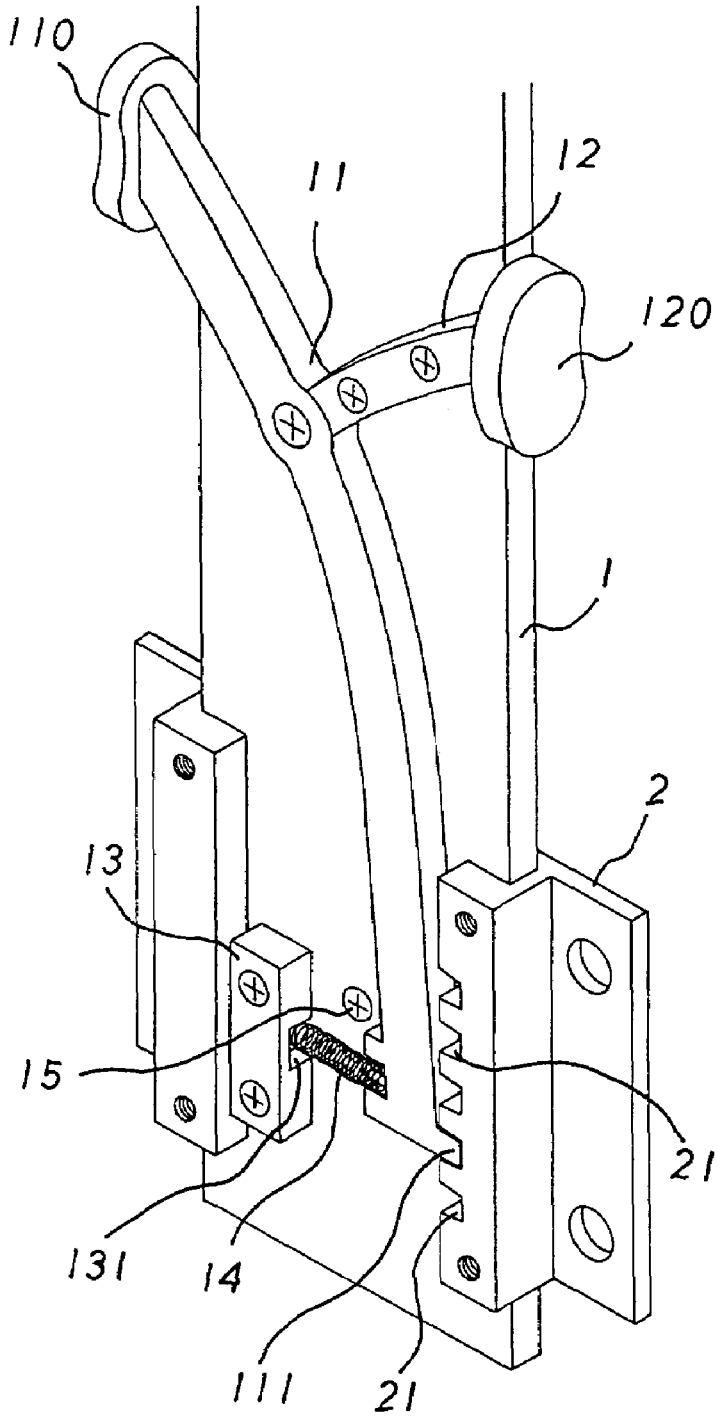
FIG. 2 is a partially perspective view of the distance adjustment device as shown in FIG. 1.
Figure 3:
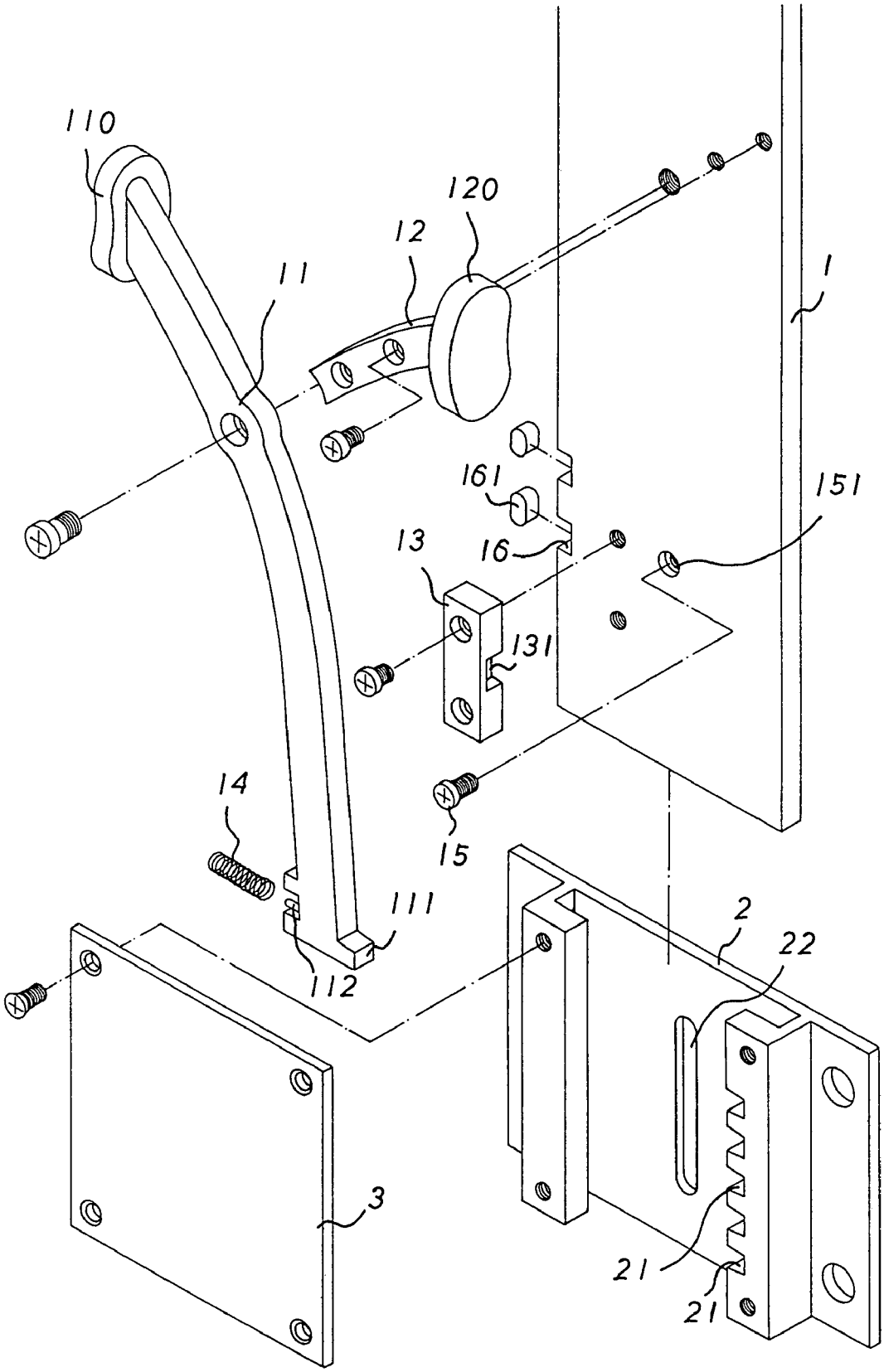
FIG. 3 is an exploded perspective view of the distance adjustment device as shown in FIG. 1.
Figure 4:
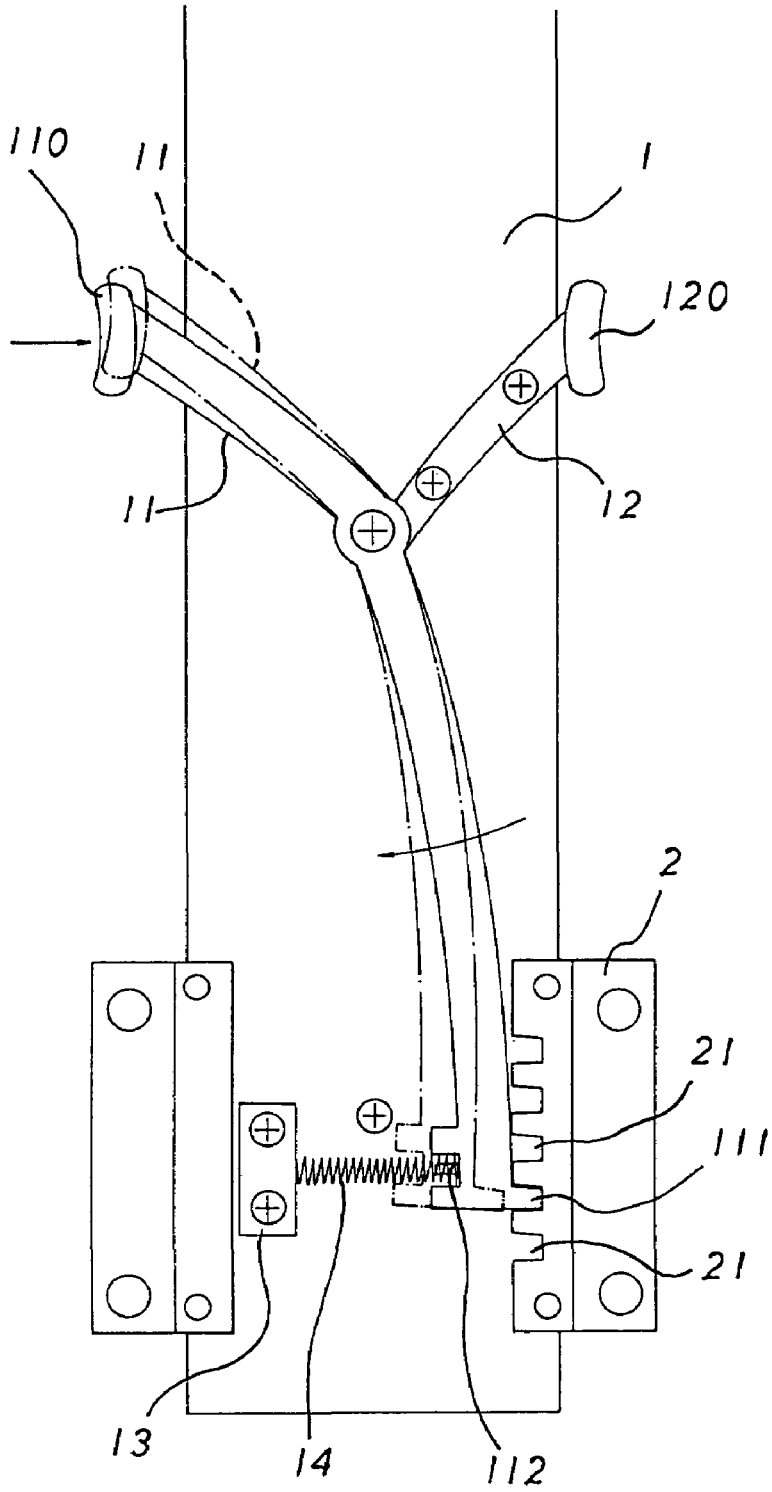
FIG. 4 is a schematic plan operational view of the distance adjustment device as shown in FIG. 2.
Figure 5:
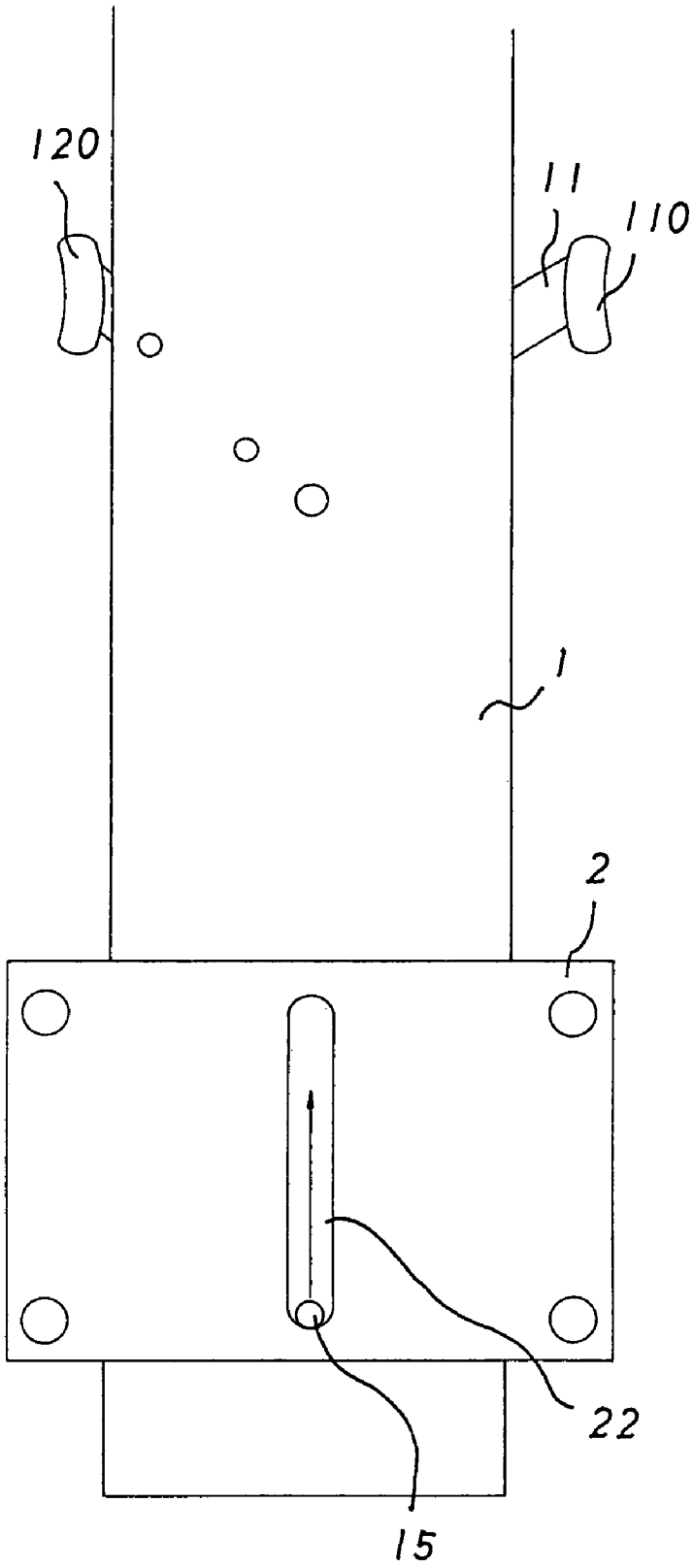
FIG. 5 is a schematic back plan operational view of the distance adjustment device as shown in FIG. 2.

Referring to the drawings and initially to FIGS. 1–3, a distance adjustment device for a chair in accordance with the preferred embodiment of the present invention comprises a guide rail 2, a movable plate 1 slidably mounted on the guide rail 2, a movable handle 11 pivotally mounted on the movable plate 1 and having a first end detachably engaged with the guide rail 2, and a fixed handle 12 secured on the movable plate 1 and located opposite to a second end of the movable handle 11.

The guide rail 2 has a side formed with a plurality of locking grooves 21 and has a surface formed with an elongated guide slot 22.

The movable plate 1 has an end formed with a screw bore 151 for screwing a guide screw 15 which is slidably mounted in the guide slot 22 of the guide rail 2 to guide movement of the movable plate 1 on the guide rail 2. The movable plate 1 has a periphery provided with a plurality of shock-absorbing blocks 161 rested on the guide rail 2 to provide a shock-absorbing effect to the movable plate 1, thereby preventing the movable plate 1 from being vibrated during movement, so that the movable plate 1 is slidable on the guide rail 2 smoothly and stably. The periphery of the movable plate 1 is formed with a plurality of receiving recesses 16 to receive the shock-absorbing blocks 161.

The first end of the movable handle 11 has a first side formed with a locking block 11 1 detachably locked in either one of the locking grooves 21 of the guide rail 2. The second end of the movable handle 11 is provided with a push portion 110 protruded outward from the movable plate 1.

The fixed handle 12 has a first end secured on the movable plate 1 and a second end provided with a grip portion 120 protruded outward from the movable plate 1 and located opposite to the push portion 110 of the movable handle 11.

The distance adjustment device further comprises a support member 13 secured on the movable plate 1 and located between the movable handle 11 and the guide rail 2, and an elastic member 14 biased between the support member 13 and a second side of the first end of the movable handle 11 to push the first end of the movable handle 11 toward the locking grooves 21 of the guide rail 2 so that the locking block 111 of the movable handle 11 is normally locked in one of the locking grooves 21 of the guide rail 2 by the elastic force of the elastic member 14. The support member 13 has a side formed with a mounting recess 131 for mounting a first end of the elastic member 14, and the second side of the first end of the movable handle 11 is provided with a mounting base 112 for mounting a second end of the elastic member 14. A cover 3 is secured on the guide rail 2 to encompass the support member 13 and the elastic member 14.

In operation, referring to FIGS. 1–5, when a user's one hand exerts a force on the push portion 110 of the movable handle 11 and the grip portion 120 of the fixed handle 12, the push portion 110 of the movable handle 11 is pushed to move toward the grip portion 120 of the fixed handle 12, so that the movable handle 11 is pivoted on the movable plate 1 to drive the locking block 111 of the movable handle 11 to move outward relative to the locking grooves 21 of the guide rail 2, thereby detaching the locking block 111 of the movable handle 11 from the locking grooves 21 of the guide rail 2 so as to unlock the movable plate 1 from the guide rail 2. Thus, the movable plate 1 is movable relative to the guide rail 2 freely so as to adjust the position between the movable plate 1 and the guide rail 2.

After adjustment, the force applied on the push portion 110 of the movable handle 11 and the grip portion 120 of the fixed handle 12 is removed to release the movable handle 11, so that the locking block 111 of the movable handle 11 is pushed to be locked in another one of the locking grooves 21 of the guide rail 2 by the restoring force of the elastic member 14, thereby locking the movable plate 1 on the guide rail 2. Thus, the movable plate 1 is fixed on the guide rail 2 automatically by the restoring force of the elastic member 14.

In practice, when the distance adjustment device is mounted on a chair, the guide rail 2 is fixed on a seat portion of the chair, and the movable plate 1 is fixed on a backrest or an armrest of the chair. Thus, the movable plate 1 is movable relative to the guide rail 2 freely so as to adjust the distance between the backrest or armrest and the seat portion.

Accordingly, the user only needs to hold the push portion 110 of the movable handle 11 and the grip portion 120 of the fixed handle 12 by his one hand to unlock and move the movable plate 1 so as to adjust the relative position between the movable plate 1 and the guide rail 2, so that the distance adjustment device is operated by the user's one hand, thereby facilitating the user adjusting the distance between the backrest (or the armrest) and the seat portion. In addition, the user only needs to push the push portion 110 of the movable handle 11 toward the grip portion 120 of the fixed handle 12 to unlock and move the movable plate 1, so that the movable plate 1 is moved easily and rapidly, thereby facilitating the user operating the distance adjustment device. Further, the movable plate 1 is fixed on the guide rail 2 automatically by the restoring force of the elastic member 14 after the distance adjustment, thereby facilitating the user operating the distance adjustment device. Further, the distance adjustment device has a simplified construction, thereby decreasing costs of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A distance adjustment device, comprising:

a guide rail;

a movable plate slidably mounted on the guide rail;

a movable handle pivotally mounted on a surface of the movable plate and having a first end detachably engaged with the guide rail, wherein the movable handle is pivotable in a direction parallel with a moving direction of the movable plate relative to the guide rail;

a fixed handle secured on the surface of the movable plate and located opposite to a second end of the movable handle;

wherein the guide rail has a protruding first side rested on the movable plate and formed with a plurality of locking grooves, and the first end of the movable handle has a first side formed with a locking block detachably locked in one of the locking grooves of the guide rail, the distance adjustment device further comprises a support member secured on the surface of the movable plate and located between the first end of the movable handle and a protruding second side of the guide rail, and an elastic member biased between the support member and a second side of the first end of the movable handle to push the first end of the movable handle toward the locking grooves of the guide rail so that the locking block of the movable handle is normally locked in one of the locking grooves of the guide rail by an elastic force of the elastic member.

2. The distance adjustment device in accordance with claim 1, wherein the support member has a side formed with a mounting recess facing the second side of the first end of the movable handle for mounting a first end of the elastic member, and the second side of the first end of the movable handle is provided with a mounting base facing the mounting recess of the support member for mounting a second end of the elastic member.

3. The distance adjustment device in accordance with claim 1, further comprising a cover secured on the guide rail to encompass the support member and the elastic member and to limit movement of the movable handle.

4. A distance adjustment device, comprising:

a guide rail;

a movable plate slidably mounted on the guide rail;

a movable handle pivotally mounted on a surface of the movable plate and having a first end detachably engaged with the guide rail, wherein the movable handle is pivotable in a direction parallel with a moving direction of the movable plate relative to the guide rail;

a fixed handle secured an the surface of the movable plate and located opposite to a second end of the movable handle;

wherein the second end of the movable handle is pivotally mounted on the surface of the movable plate to function as a pivot fulcrum of the movable handle relative to the movable plate and is provided with a protruding push portion, and the fixed handle has a first end secured on the surface of the movable plate and rested on the second end of the movable handle and a second end provided with a protruding grip portion located opposite to the push portion of the movable handle.

5. The distance adjustment device in accordance with claim 4, wherein the push portion of the movable handle is protruded outward from a first edge of the surface of the movable plate.

6. The distance adjustment device in accordance with claim 5, wherein the grip portion of the fixed handle is protruded outward from a second edge of the surface of the movable plate.

7. A distance adjustment device, comprising:

a guide rail;

a movable plate slidably mounted on the guide rail;

a movable handle pivotally mounted on a surface of the movable plate and having a first end detachably engaged with the guide rail, wherein the movable handle is pivotable in a direction parallel with a moving direction of the movable plate relative to the guide rail;

a fixed handle secured on the surface of the movable plate and located opposite to a second end of the movable handle;

wherein the guide rail has a surface formed with an elongated oblong guide slot, and the movable plate has an end formed with a screw bore connected between the guide slot and the surface of the movable plate for screwing a guide screw which is slidably mounted in the guide slot of the guide rail to guide movement of the movable plate on the guide rail.

8. The distance adjustment device in accordance with claim 1, wherein the movable plate has a periphery provided with a plurality of shock-absorbing blocks rested on a surface of the guide rail to provide a shock-absorbing effect to the movable plate, thereby preventing the movable plate from being vibrated during movement, so that the movable plate is slidable on the guide rail smoothly and stably.

9. The distance adjustment device in accordance with claim 8, wherein the periphery of the movable plate has an end face formed with a plurality of receiving recesses to receive the shock-absorbing blocks.

10. The distance adjustment device in accordance with claim 4, wherein when a user exerts a force on the push portion of the movable handle and the grip portion of the fixed handle, the push portion of the movable handle is pushed to move toward the grip portion of the fixed handle, so that the second end of the movable handle is pivoted on the surface of the movable plate to disengage the guide rail from the movable handle so as to unlock the movable plate from the guide rail.

11. The distance adjustment device in accordance with claim 1, wherein the movable handle is a substantially arc-shaped plate rested on the surface of the movable plate.

12. The distance adjustment device in accordance with claim 1, wherein the fixed handle and the second end of the movable handle form a substantially V-shaped profile.

* * * * *